United States Patent [19]

Seitz

[11] B 3,995,692

[45] Dec. 7, 1976

[54] CONTINUOUS ORIFICE FILL DEVICE

[75] Inventor: Peter W. Seitz, Wichita Falls, Tex.

[73] Assignee: The Dow Chemical Company, Midland, Mich.

[22] Filed: July 26, 1974

[21] Appl. No.: 492,120

[44] Published under the second Trial Voluntary Protest Program on February 24, 1976 as document No. B 492,120.

[52] U.S. Cl. ..... 166/318; 137/515

[51] Int. Cl.[2] ..... E21B 41/00

[58] Field of Search ..... 166/224, 225; 137/515, 137/515.5

[56] References Cited

UNITED STATES PATENTS

| | | | |
|---|---|---|---|
| 3,275,080 | 9/1966 | Nelson et al. | 166/225 |
| 3,289,769 | 12/1966 | Nelson et al. | 166/224 |
| 3,292,707 | 12/1966 | Nelson et al. | 166/224 |

*Primary Examiner*—James A. Leppink
*Attorney, Agent, or Firm*—Earl D. Ayers

[57] ABSTRACT

The invention concerns down-hole apparatus for use especially in casing cementing operations wherein a so-called string of casing is lowered into a well bore and cemented in place. The apparatus comprises an insert, disposed across the interior of the casing, containing a spring loaded flapper valve assembly which is held open by a movable valve seating member until a ball is seated in the seating member and pressure applied through the casing to the sealed valve seating member forces the seating member downward, releasing the flapper valve, and expands the lower end of the seating member as the ball is forced through it. On release of the casing pressure from above, the flapper valve closes.

A plurality of the inventive devices may be placed along the casing, the ball valve sealing each, in turn, from top to bottom.

6 Claims, 1 Drawing Figure

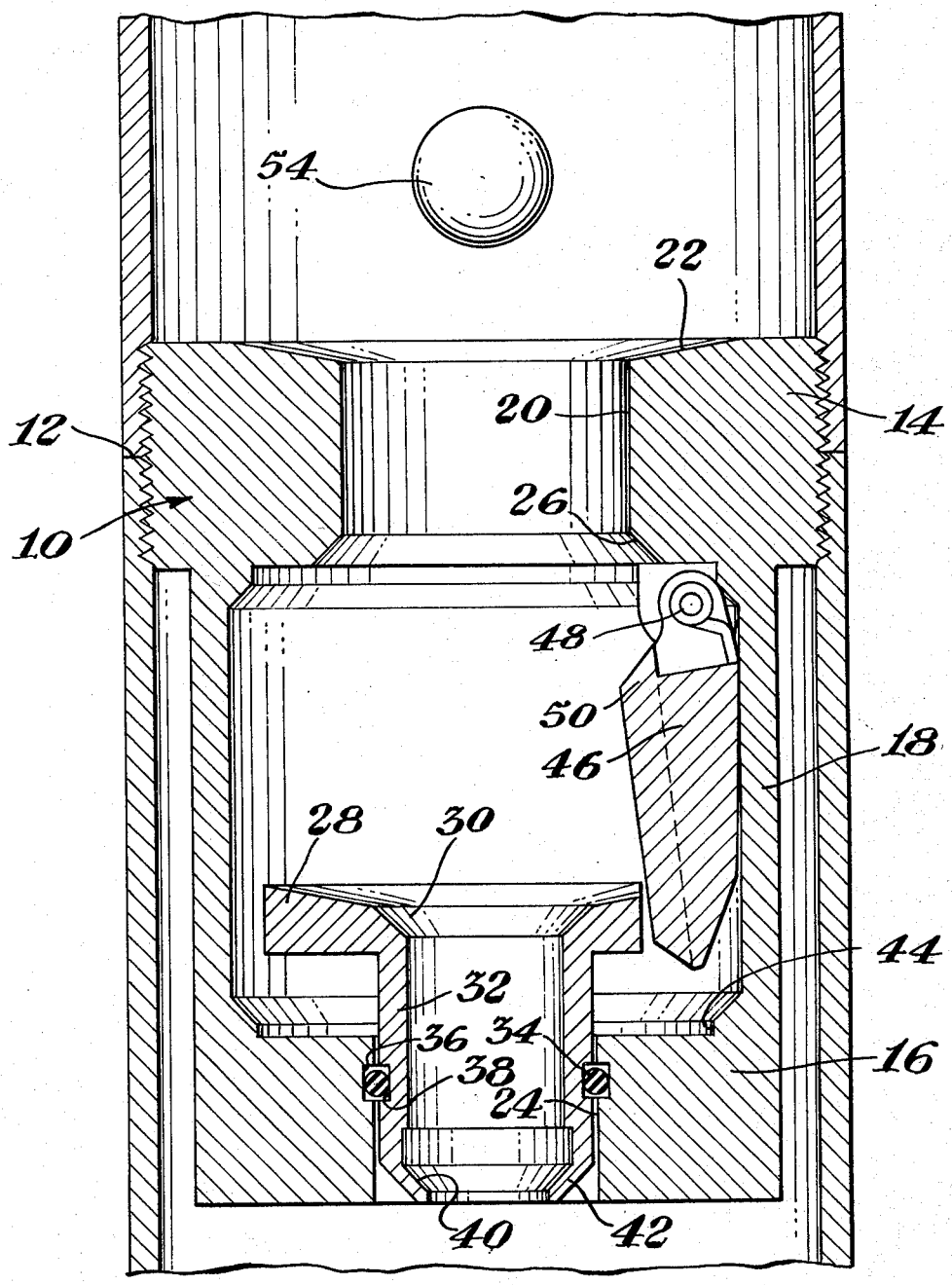
54
22
20
14
12
10
26
48
50
46
18
28
30
44
32
36
34
16
38
24
40
42

CONTINUOUS ORIFICE FILL DEVICE

BACKGROUND OF THE INVENTION

This invention relates to apparatus used in completing or treating earth wells and particularly to continuous orifice fill devices.

As casing is lowered into an earth well, a shoe at the lower end of the casing is usually provided which has an orifice device coupled across its open end. The orifice device restricts the amount of upward flow of material through the casing as the casing is lowered into the well bore, thus allowing the casing to partially "float" its way down the well bore.

In addition, such devices usually have a valve which may be actuated to prevent back flow of material up the casing once the casing is "set" in position in the well bore.

Often, the upward flow preventing valve of the device is actuated by plugging the orifice of the device and then applying pressure from above to break shear pins holding the inner orifice part in place to release the valve as the inner orifice part is removed.

It has been found that the valves of such devices often do not fully seal off back flow into the casing. The use of two or more orifice devices along the casing would provide better sealing, but the "break away" part of the upper device would interfere with the actuating of the valves of the lower device(s).

OBJECTS OF THE INVENTION

Accordingly, a principal object of this invention is to provide an improved down-hole flow controllable orifice device.

Another object of this invention is to provide an improved down-hole tool having pressure actuated deformable and movable valve actuating means incorporated therein.

A further object of this invention is to provide an improved down-hole flow controllable orifice device which is compatible for use in conjunction with other such devices.

STATEMENT OF INVENTION

In accordance with this invention there is provided a down-hole flow controllable orifice device adapted to be coupled to a "string" of casing. The device includes an insert, disposed across the interior of the casing, which contains a spring loaded flapper valve assembly in which the flapper valve is held open by a movable valve seating member. Downward movement of the valve seating to release the flapper valve member is achieved by seating a valve ball, then applying pressure above the valve ball. Further pressure above the valve ball forces the valve seat to expand and let the valve ball pass through.

The valve ball then may be similarly used to actuate another down-hole flow controllable orifice device disposed lower in the casing "string".

BRIEF DESCRIPTION OF THE DRAWING

The invention, as well as additional objects and advantages thereof, will best be understood when the following detailed description is read in connection with the accompanying drawing which is a sectional view of the apparatus of this invention shown coupled to a "string" of casing.

DETAILED DESCRIPTION OF THE DRAWING

Referring to the drawing, there is shown orifice fill apparatus, indicated generaly by the numeral 10, coupled across the interior of a "string" of casing 12.

The apparatus 10 comprises a generally disc-like casing coupling part 14 having a centrally disposed aperture 20 extending therethrough. A beveled valve seat 26 borders the lower end of the bore 20. The upper surface 22 of the part 14 is beveled towards the bore 26 whereby a ball valve element 54 dropped down the casing 12 and striking the part 14 would roll into the aperture 20.

A flapper valve 46 having a seating surface 50 is pivotally mounted around pin 48 in a spring loaded manner adjacent to the seating surface 26.

A tubular part 18 extends downwardly from the disc-like coupling part and is coupled to a generally disc-like part 16. The part 16 has a centrally disposed bore 24 extending therethrough.

A tubular element, indicated generally by the numeral 28, has tubular walls 32, an outwardly extending flanged part 30 at its upper end and an inwardly extending valve seating part 42 at its lower end. The seating part has a beveled seating surface 40.

The tubular element 28 is held with its flanged part 30 disposed above the counter bored top part 44 of the part 18, the flanged part 30 holding the flapper valve 46 in its opened position. The means for holding the part 28 as described above is an O ring 34 disposed in grooves 36, 38 in the walls of the disc-like part 16 and the tubular wall 32, respectively. The tubular wall 32 fits loosely within bore 24.

The upper surface of the outwardly extending flanged part 30 is beveled to direct anything striking it to the central open part of the part 28.

OPERATION

In operation, the device 10 is coupled to a casing string and lowered into a well bore (not shown). After cement or other well treating material has been pumped down the casing it is then desirable to prevent back flow through the device 10.

A valve ball 54 is dropped into the casing, passes through the bore 20, into the interior of the part 28 and seats against the valve seating surface 40.

Pressure is applied through the casing 12 in an amount sufficient to move member 28 downwardly. O ring 34 is compressed between the tubular wall 32 and bore 24 where it seals against liquid bypassing member 28 as it moves. The downwardly movement of member 28 releases the flapper valve 48 so that it may seat against the seating surface 26 and prevent back flow of material.

On application of higher pressure the end part 42 of the member 28, which is made of malleable material, expands to permit the valve ball 54 to pass through the lower end of the member 28.

The structure of the apparatus of this invention is advantageously used when two or more orifice fill devices are disposed in sequence along the casing string. A single valve ball may be used to actuate the flapper valve in each device. There are no break away parts of orifice fill devices in accordance with this invention to interfere with the operation of such devices disposed further down the casing.

If each flapper valve provided a complete seal, only one orifice fill device would be needed. However, cement or other material on the valve seating surfaces may prevent a complete seal. The use of multiple orifice fill devices greatly reduces the chances of an incomplete seal-off of material below the devices 10.

The member 28 may be made of malleable aluminum, for example, or other material having suitable physical properties.

What is claimed is:

1. A continuous orifice fill device comprising a disc-like cross member having edge coupling means for attaching it in a sealing relationship around the inner wall of a string of casing, said cross member having a top which is beveled towards the center of said cross member, an axial bore extending through said cross member, and a bottom part including a flapper valve assembly including a valve seat surrounding said axial bore and a hinged flapper valve, a second cross member, said second cross member being disposed below said first cross member and coupled and sealed with respect to said first cross member by tubular walls which are disposed within said string of casing, said second cross member having an axial bore extending therethrough, a movable metal valve seat member having an upper position and a lower position, said valve seat member having a tubular walled part having an upper end including an outwardly extending flanged part and an inwardly extending non-resilient pressure deformable valve seat including a valve seating surface at its lower end, said valve seat member having its walled part extending closely but slidably through said axial bore in said second cross member whereby its outwardly extending flanged part retains said hinged flapper valve in an open position when said valve seat member is in its upper position, means for maintaining said valve seat member in its upper position until a predetermined pressure is reached on said pressure deformable valve seat, said axial bore of said first cross member and said tubular walled part of said valve seat member being dimensioned to permit a valve element to pass through and seal against said inwardly extending pressure deformable valve seat.

2. A device in accordance with claim 1 wherein said tubular walls are spaced from said casing.

3. A device in accordance with claim 1 wherein said means for maintaining said valve seat member in its upper position comprises an O ring disposed in loosely mating grooves in the walled part of said valve seat member and the wall of said axial bore in said second cross member.

4. A device in accordance with claim 1 wherein said outwardly extending flanged part of said valve seat member has an upper surface part which slopes towards the center of said member.

5. A device in accordance with claim 1 wherein said inwardly extending valve seat is made of malleable material.

6. A device in accordance with claim 1 wherein said hinged flapper valve is spring loaded.

* * * * *